US010808450B2

(12) United States Patent
Westington et al.

(10) Patent No.: US 10,808,450 B2
(45) Date of Patent: Oct. 20, 2020

(54) REMOVABLE SECURITY DEVICE

(71) Applicant: Spinnaker International Limited, Saltash, Cornwall (GB)

(72) Inventors: Tony Westington, Saltash (GB); Nick Tripp, Saltash (GB)

(73) Assignee: Spinnaker International Limited, Saltash, Cornwall (GB)

( * ) Notice: Subject to any disclaimer, the term of this patent is extended or adjusted under 35 U.S.C. 154(b) by 0 days.

(21) Appl. No.: 15/543,972

(22) PCT Filed: Dec. 18, 2015

(86) PCT No.: PCT/GB2015/054077

§ 371 (c)(1),
(2) Date: Jul. 14, 2017

(87) PCT Pub. No.: WO2016/113527

PCT Pub. Date: Jul. 21, 2016

(65) Prior Publication Data

US 2018/0313135 A1 Nov. 1, 2018

(30) Foreign Application Priority Data

Jan. 15, 2015 (GB) ..... 1500657.0

(51) Int. Cl.
*E05G 1/12* (2006.01)
*G07D 11/125* (2019.01)
(Continued)

(52) U.S. Cl.
CPC ..... *E05G 1/12* (2013.01); *E05G 1/005* (2013.01); *E05G 1/10* (2013.01); *G07D 11/125* (2019.01);
(Continued)

(58) Field of Classification Search
CPC ..... E05G 1/12; E05G 1/0005; E05G 1/10; E05G 1/00; E05G 1/005; G07D 11/0009;
(Continued)

(56) References Cited

U.S. PATENT DOCUMENTS 3,564,525 A * 2/1971 Robeson ..... C08B 15/00 109/25
3,703,780 A * 11/1972 King ..... E05G 1/12 42/1.08
(Continued)

FOREIGN PATENT DOCUMENTS

DE 202014102826 U1 7/2014
EP 0580297 A2 1/1994
(Continued)

OTHER PUBLICATIONS

European Patent Office; International Search Report & Written Opinion for PCT/GB2015/054077; dated Jul. 3, 2016; Rijswijk; NL; 10 pages.
(Continued)

*Primary Examiner* — Suzanne L Barrett
(74) *Attorney, Agent, or Firm* — Knobbe, Martens, Olson & Bear LLP

(57) ABSTRACT

A removable portable security device (60, 90, 110, 120) for installation in a machine (10) for dispensing, receiving or recycling cash, wherein the machine (10) includes a cash space for storing cash, the security device (60, 90, 110, 120) comprising: a detection system (66, 100, 114, 124) for detecting unauthorised interference with the machine (10); and a cash protection system (68, 92, 112, 122) configured to activate on detection by the detection system (66, 100, 114, 124) of unauthorised interference with the machine, wherein the security device (60, 90, 110, 120) is configured to occupy part of the cash space of the machine (10).

2 Claims, 10 Drawing Sheets

(51) Int. Cl.

| | |
|---|---|
| ***G07D 11/225*** | (2019.01) |
| ***G07F 19/00*** | (2006.01) |
| ***G08B 13/14*** | (2006.01) |
| ***G08B 25/10*** | (2006.01) |
| ***G08B 21/16*** | (2006.01) |
| ***G07G 3/00*** | (2006.01) |
| ***E05G 1/00*** | (2006.01) |
| ***E05G 1/10*** | (2006.01) |

(52) U.S. Cl.
CPC ..... *G07D 11/225* (2019.01); *G07F 19/201* (2013.01); *G07F 19/205* (2013.01); *G07F 19/209* (2013.01); *G07G 3/003* (2013.01); *G08B 13/1436* (2013.01); *G08B 21/16* (2013.01); *G08B 25/10* (2013.01); *G07D 2211/00* (2013.01)

(58) Field of Classification Search
CPC ..... G07D 11/0042; G07D 2211/00; G07D 11/125; G07D 11/225; G07F 19/205; G07F 19/209; G07F 19/201; G07G 3/003; G08B 13/1436; G08B 25/10; G08B 21/16
USPC ..... 109/25, 29, 31–34, 38, 39, 45
See application file for complete search history.

(56) References Cited

U.S. PATENT DOCUMENTS

| | | | | | |
|---|---|---|---|---|---|
| 3,781,860 | A * | 12/1973 | Freyling, Jr. | G08B 13/2431 | 340/539.13 |
| 3,828,341 | A * | 8/1974 | Carter, Jr. | G08B 13/24 | 340/568.7 |
| 4,573,043 | A * | 2/1986 | Heuker of Hoek | G08B 15/00 | 340/542 |
| 4,639,716 | A * | 1/1987 | Payne | G08B 13/14 | 340/523 |
| 4,833,456 | A * | 5/1989 | Heller | A63C 11/005 | 280/816 |
| 4,975,680 | A * | 12/1990 | Fogle, Jr. | G07F 19/20 | 340/522 |
| 5,410,295 | A * | 4/1995 | Van Lint | G07F 9/02 | 340/309.16 |
| 5,515,032 | A * | 5/1996 | Johnson | G08B 13/1436 | 340/529 |
| 6,712,011 | B2 * | 3/2004 | Fumanelli | E05G 1/005 | 109/20 |
| 6,895,873 | B1 * | 5/2005 | Searle | E05G 1/005 | 109/25 |
| 7,656,292 | B2 * | 2/2010 | Bartholf | G06Q 10/08 | 109/15 |
| 8,217,791 | B2 * | 7/2012 | Grimm | G01S 5/0027 | 340/539.13 |
| 9,786,146 | B2 * | 10/2017 | Markwell | G08B 13/2462 | |
| 2003/0033965 | A1 * | 2/2003 | Van Lint | E05G 1/14 | 109/29 |
| 2004/0007165 | A1 * | 1/2004 | Abe | E05G 1/14 | 109/20 |
| 2005/0010525 | A1 * | 1/2005 | Ross | G06K 7/0008 | 705/43 |
| 2005/0051448 | A1 * | 3/2005 | Miles | G07D 11/0009 | 206/459.1 |
| 2005/0121508 | A1 * | 6/2005 | Fumanelli | A45C 13/24 | 235/379 |
| 2009/0235847 | A1 * | 9/2009 | Villiger | E05G 1/14 | 109/25 |
| 2015/0191960 | A1 * | 7/2015 | Robson | B65D 85/00 | 109/25 |

FOREIGN PATENT DOCUMENTS

| | | |
|---|---|---|
| GB | 2442798 A | 4/2008 |
| KR | 2006-0028096 | 3/2006 |
| WO | 93/02435 A1 | 2/1993 |

OTHER PUBLICATIONS

European Patent Office; International Preliminary Report on Patentability for PCT/GB2015/054077; Mar. 22, 2017; Munich; DE; 21 pages.
Communication under Rule 71(3) issued in European Application No. 15 813 558.2-1206 dated Jun. 13, 2018.
Examiner's Report issued in Canadian Application No. 2,973,316 dated May 11, 2018.
Examination Report No. 1 issued in Australian Application No. 2015377819 dated Dec. 20, 2017.
Communication pursuant to Article 94(3) EPC issued in European Application No. 15 813 558.2-1206 dated Sep. 13, 2017.
Notification of Transmittal of International Search Report and the Written Opinion of the International Searching Authority, or the Declaration issued in International Application No. PCT/GB2015/054077 dated Mar. 7, 2016.
Written Opinion of the International Preliminary Examining Authority issued in International Application No. PCT/GB/2015/054077 dated Nov. 29, 2016.

* cited by examiner

REMOVABLE SECURITY DEVICE

TECHNICAL FIELD

The present application relates to a removable portable security device for installation in a machine for dispensing, receiving or recycling cash.

BACKGROUND TO THE INVENTION

Automated teller machines (ATMs) provide a convenient way for account holders to access funds held in their bank accounts using a card having either (or both) a magnetic strip or a microchip encoded with data that identifies the account to which the card is linked to provide access to that account, provided that the user of the ATM can verify his identity, typically by entering a numeric code using a keyboard of the ATM.

In order to provide a reliable service ATMs typically store a large amount of cash, in the form of bank notes, in one or more replaceable cash cassettes held in a safe or other secure area of the ATM. When the cash cassettes are empty or almost empty the ATM is replenished, typically by replacing the empty or almost empty cash cassettes with full cash cassettes.

Because full cash cassettes and even partially full cash cassettes can hold a significant amount of cash, they are often targeted by thieves. ATMs and ATM cassettes are typically provided with security systems that are designed to deter thieves from attempting to gain access to the cash stored within them. Such systems typically include detectors to detect unauthorised attempts to access the cash cassette(s) and alarms to notify authorities of the attempted theft. Some security systems also include spoiling systems that are operative to spoil the cash stored in the ATM or cash cassette on detection of an attempted theft, by dispensing an indelible ink, dye, adhesive or other spoiling agent onto the cash, thereby rendering it unusable and worthless. Some security systems for ATMs additionally or alternatively include gas neutralisation systems, which are designed to detect the presence of explosive gases and release a substance such as an inert gas that can be used to neutralise or displace the explosive gas, thereby preventing the ATM from being breached by introducing an explosive gas into its interior and igniting the explosive gas.

Whilst security systems of the kind described above can be effective in deterring thieves, they can represent a significant capital investment for a financial institute. For bank note spoiling systems that use ink, dye or adhesive, each ATM cassette that may be used in an ATM must be upgraded. This could mean that up to six or eight cassettes per ATM must be upgraded. Where a gas neutralisation system is to be installed in an ATM an engineer will need to visit the ATM and gain access to its safe in order to install the necessary equipment. In addition to the significant capital expenditure required, fitting or retrofitting ATMs and ATM cassettes with security systems is a time consuming process, involving identifying an appropriate solution, seeking and obtaining approval for the capital expenditure, waiting the lead-time for the equipment and then installing or upgrading the ATM. This time frame could be anywhere up to six months, by which time many attacks may have taken place and the losses to the financial institution may have become significant.

Often attacks on ATMs are carried out by criminal gangs which move from region to region within a country or territory. Due to the significant capital investment costs of security systems it is not always possible to equip every ATM or ATM cassette with a security system, and moving security equipped ATMs to different regions within a country or territory as the attacks move is very difficult logistical problem.

One way that this issue has been addressed by financial institutions with no or a limited number of security equipped ATMs is that when intelligence is received by the financial institution indicating that attacks on ATMs have occurred or are likely to occur in a particular geographical region, the amount of cash held in each ATM cassette in the ATMs within that region is reduced by the financial institution. This reduces the attractiveness of the affected ATMs to criminals, as the value of the cash stored within those ATMs is reduced, thereby reducing the likelihood of attacks on those ATMs and limiting the losses that will be incurred in the event of a successful attack on an ATM.

However, this approach has its own disadvantages, principally in a reduced level of service to customers, since less cash is available to dispense from the affected ATMs, and the attendant increased operating costs, since the ATMs will require more frequent replenishment.

Accordingly, a need exists for a way to protect ATMs and other machines for dispensing, receiving or recycling cash from attacks, without incurring the significant capital expenditure of fitting or retrofitting the machines with security systems.

SUMMARY OF INVENTION

According to a first aspect of the present invention there is provided a removable portable security device for installation in a machine for dispensing, receiving or recycling cash, wherein the machine includes a cash space for storing cash, the security device comprising: a detection system for detecting unauthorised interference with the machine; and a cash protection system configured to activate on detection by the detection system of unauthorised interference with the machine, wherein the security device is configured to occupy part of the cash space of the machine.

The security device of the present invention is a dedicated security device whose sole purpose is to protect the cash in a machine for dispensing, receiving or recycling cash, such as an automated teller machine. The security device can be quickly and cost-effectively installed in and removed from a machine. In this way, the machine may be protected on an ad-hoc basis when intelligence is received that an attack is threatened, without having to incur the significant capital costs and delays involved in fitting or retrofitting the machine or the cash cassettes used in the machine with a permanent security system. When the threat of an attack has receded, the device can quickly and simply be removed from the machine, transported to and installed in another machine in a region of heightened threat of attack.

As well as providing a quick, cost-effective and convenient means of protecting a particular machine, the security device of the present invention does not permanently compromise the cash storage capacity of the machine. When installed in the machine the security device occupies part of the intended cash space of the machine, cash. However, when the security device is removed, the intended cash space can revert to its normal function of accommodating cash. Thus, the temporary reduction in the cash storage capacity of the machine when the security device is installed is reversed when the security device is removed.

The cash space may comprise a bay for receiving a cash cassette, and the security device may be configured to be received in the bay in place of a cash cassette.

Alternatively, the cash space may comprise a bay for receiving a cash cassette, and the security device may be configured to attach to the bay without occupying the bay.

For example, the security device may be configured to attach to an underside of the bay in use, so as to depend from the bay.

Alternatively, the security device may be configured to attach to a wall or floor of the machine such that the security device extends in to the cash space of the machine.

The detection system may comprise a gas sensor and the cash protection system may comprise a gas neutralisation system.

Thus, the security device may be configured to neutralise explosive gas based attacks on the machine.

Additionally or alternatively, the detection system may comprise a motion sensor and the cash protection system may comprise a tracker to permit tracking of the security device.

Thus, in the event of a successful attack on the machine, the location of the device can be tracked, which may facilitate recovery of the machine and identification capture of the criminals responsible for the attack.

Additionally or alternatively, the detection system may comprise a motion sensor and the cash protection system may comprise a taggant dispensing device for dispensing a taggant.

The cash protection system may be configured to activate after a delay of a predetermined period of time after detection by the detection system of unauthorised interference with the machine.

This delay in activation of the cash protection system increases the likelihood that an individual responsible for an attack on an ATM or other cash dispensing, receiving or recycling machine will be tagged by the taggant, as the delay allows the individual sufficient time to approach the security device and come within range of the taggant dispensing device.

The taggant may comprise DNA and/or a rare earth and metal mixture, and/or an identifier that is visible under ultraviolet light.

The use of a taggant may facilitate the identification for the criminals responsible for an attack on the machine, by marking the criminals or their clothing or equipment with a taggant which also marks the machine, the security device and/or the cash, thereby providing an evidential link between the criminals and the machine, the security device and/or the cash.

The cash protection system may comprise a spoiling system configured to dispense a spoiling agent over the contents of the machine on detection by the detection system of unauthorised interference with the machine.

The spoiling agent may comprise one or more of: an ink; a dye; or an adhesive.

The use of a spoiling agent may act as a deterrent to criminals seeking to target the machine, as in the event of an attack on the machine the cash may be marked or otherwise spoiled by the spoiling agent, rendering it worthless.

The security device may further comprise a distribution device configured to distribute the spoiling agent to cash cassettes installed in the machine on activation of the cash protection system.

The distribution device may comprise a generally hollow feed pipe which connects to an outlet of the security device to permit the spoiling agent to be distributed to the cash cassettes.

Advantageously, the feed pipe is substantially rigid.

The distribution device may comprise a plurality of branches in fluid communication with the feed pipe for engaging with the cash cassettes to permit the spoiling agent to be distributed to the cash cassettes.

The distribution device may be rotatably mountable in the machine such that the branches can move between a first position in which they do not impede removal of the cash cassettes from the machine and a second position in which they impede removal of the cash cassettes from the machine.

The security device may be substantially the same shape and size as a standard cash cassette for installation in the machine for dispensing, receiving or recycling cash.

Further, the security device may have substantially the appearance of a standard cash cassette for installation in the machine.

By making the shape, size and/or appearance of the security device identical or similar to those of a standard cash cassette for installation in the machine, the purpose of the security device can be concealed, thereby making it more difficult for a criminal to identify the security device in the course of an attack on the machine and attempt to disable it.

According to a second aspect of the invention there is provided a cash processing machine comprising a cash space for storing cash, wherein part of the cash space is occupied by a security device according to any the first aspect.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
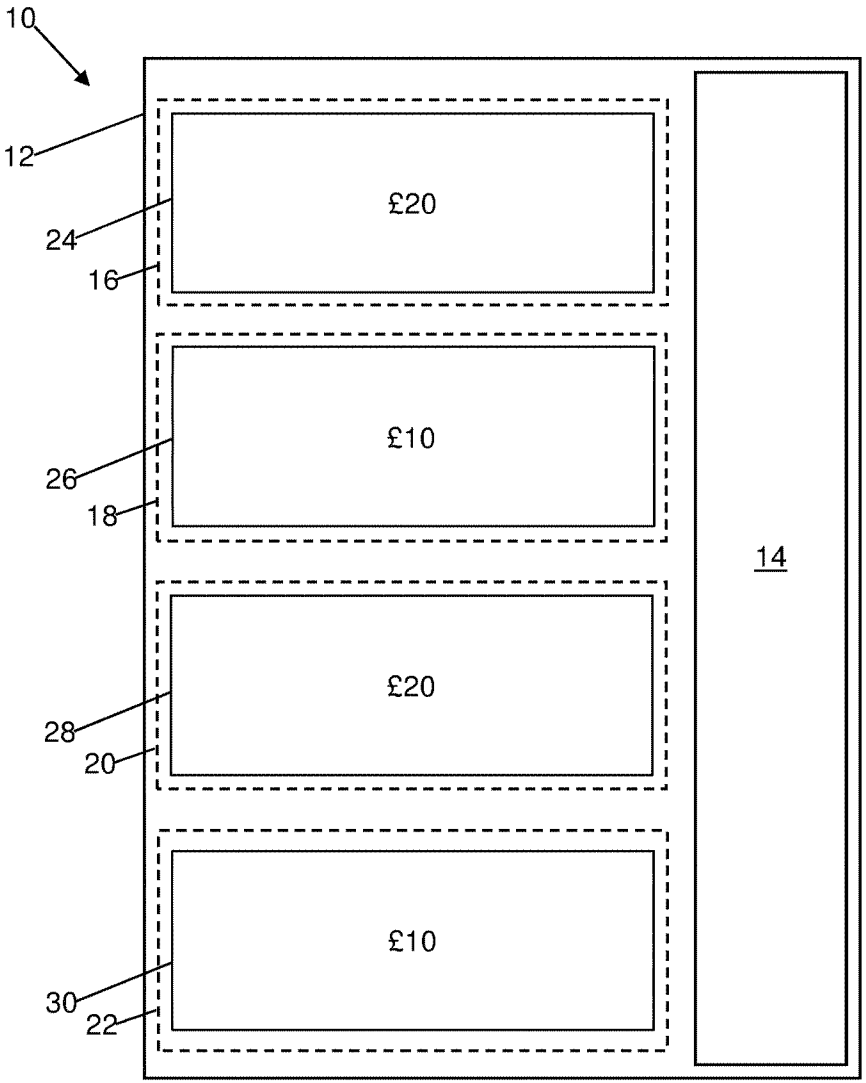
FIG. 1 is a schematic representation of an automated teller machine (ATM)

Referring first to FIG. 1, a machine for dispensing, receiving or recycling cash is shown, in schematic form, at 10. In the illustrated example, the machine is an automated teller machine (ATM), but it is to be understood that the principles of the present invention are applicable to any cash-handling machine, such as machines for dispensing, receiving or recycling cash, including (but not limited to) ATMs, automated deposit receiving machines, and cash receiving and recycling machines used in retail outlets. Further, it will be appreciated that the functional blocks shown in FIG. 1 are merely illustrative of the general structure and configuration of an ATM, and do not necessarily represent actual physical components of an ATM. Moreover, only those elements of an ATM that are relevant to the present invention are illustrated in FIG. 1; it will be appreciated that an ATM is a complex system including numerous elements and components that are not shown in FIG. 1.

The ATM 10 includes a housing 12 (in this example a safe) which houses a processing system 14 such as a PC (personal computer) that controls the operation of the ATM 10. The housing 12 also includes a plurality (in this example four) of bays 16, 18, 20, 22 in which cash cassettes 24, 26, 28, 30 can be received. The cash cassettes 24, 26, 28, 30 contain cash in the form of bank notes of different denominations that can be dispensed by the ATM 10 in response to a valid request from a user of the ATM 10.

As described above, a need exists for a way to protect ATMs and other machines for dispensing, receiving or recycling cash from attacks, without incurring the significant capital expenditure of fitting or retrofitting the machines with security systems. The present disclosure presents a removable portable security device that can be quickly, easily and cost-effectively fitted to such machines when required, and equally quickly, easily and cost-effectively removed when not required, as will now be described.

Figure 2:
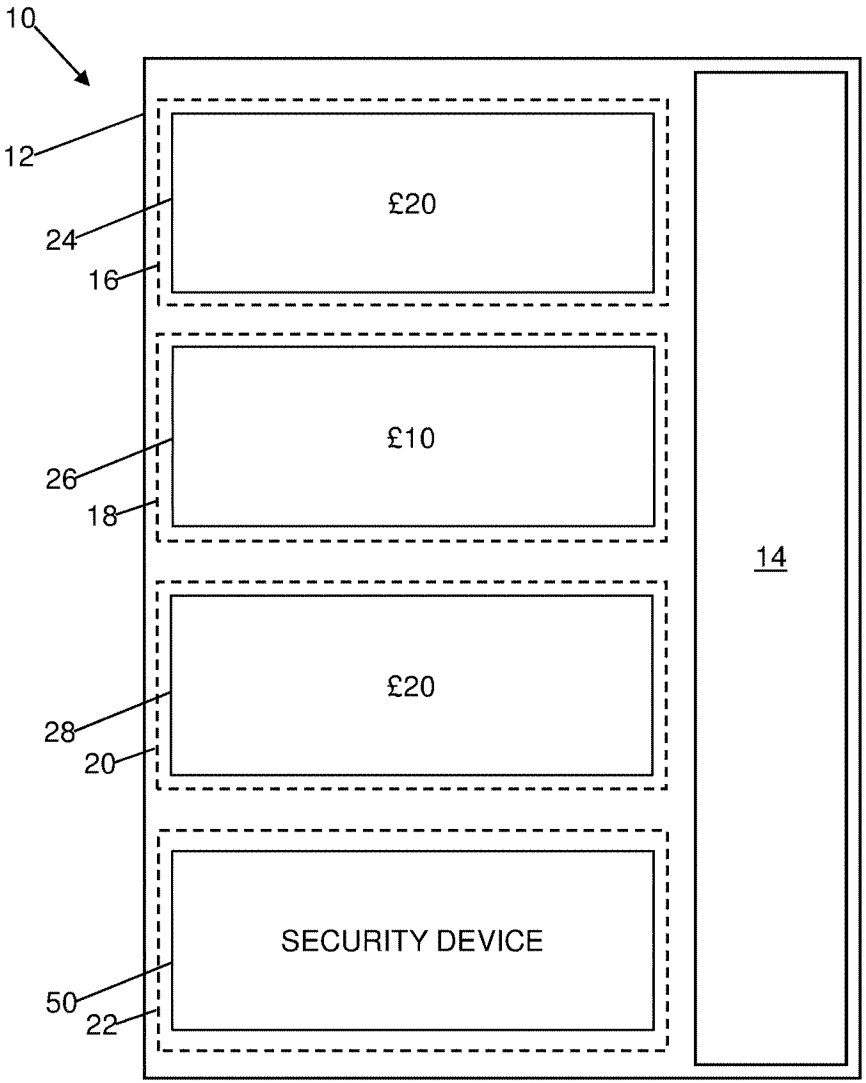
FIG. 2 is a schematic representation of an ATM in which a security device has been installed in a bay for receiving a cash cassette.

FIG. 2 is a schematic representation of the ATM 10 of FIG. 1, in which a removable portable security device, shown at 50, has been installed in the lowermost cash cassette bay 22 in place of the cash cassette 30. Thus, the removable security device 50 occupies the whole or part of the bay 22 that may otherwise have been occupied by the cash cassette 30. The security device 50 is configured to be received and accommodated in one of the cash cassette bays 16, 18, 20, 22 of the ATM 10, and it will be appreciated of course that although in FIG. 2 the removable security device 50 is shown as being installed in the lowermost cash cassette bay 22, it could be installed in any one of the cash cassette bays 16, 18, 20, 22. In some embodiments the security device 50 takes the form of a modified cash cassette, and so is substantially the same shape and size as a standard cash cassette for use in the ATM 10 and has an appearance that is substantially the same as that of a standard cash cassette for use in the ATM 10. This helps to conceal the purpose of the security device 50, making it more difficult for criminals to identify the security device 50 and attempt to disable it during an attack. However, the shape, size and appearance of the security device 50 need not necessarily be similar to those of a standard cash cassette for use in the ATM 10, provided that the security device 50 is shaped and sized so as to be received and accommodated within one of the cash cassette bays 16, 18, 20, 22 of the ATM. Indeed, making the security device highly visible and distinctive may act as a deterrent to would-be thieves during an attack on the ATM 10. It is to be understood that the removable security device 50 is configured not to hold or store any cash itself.

Figure 3:
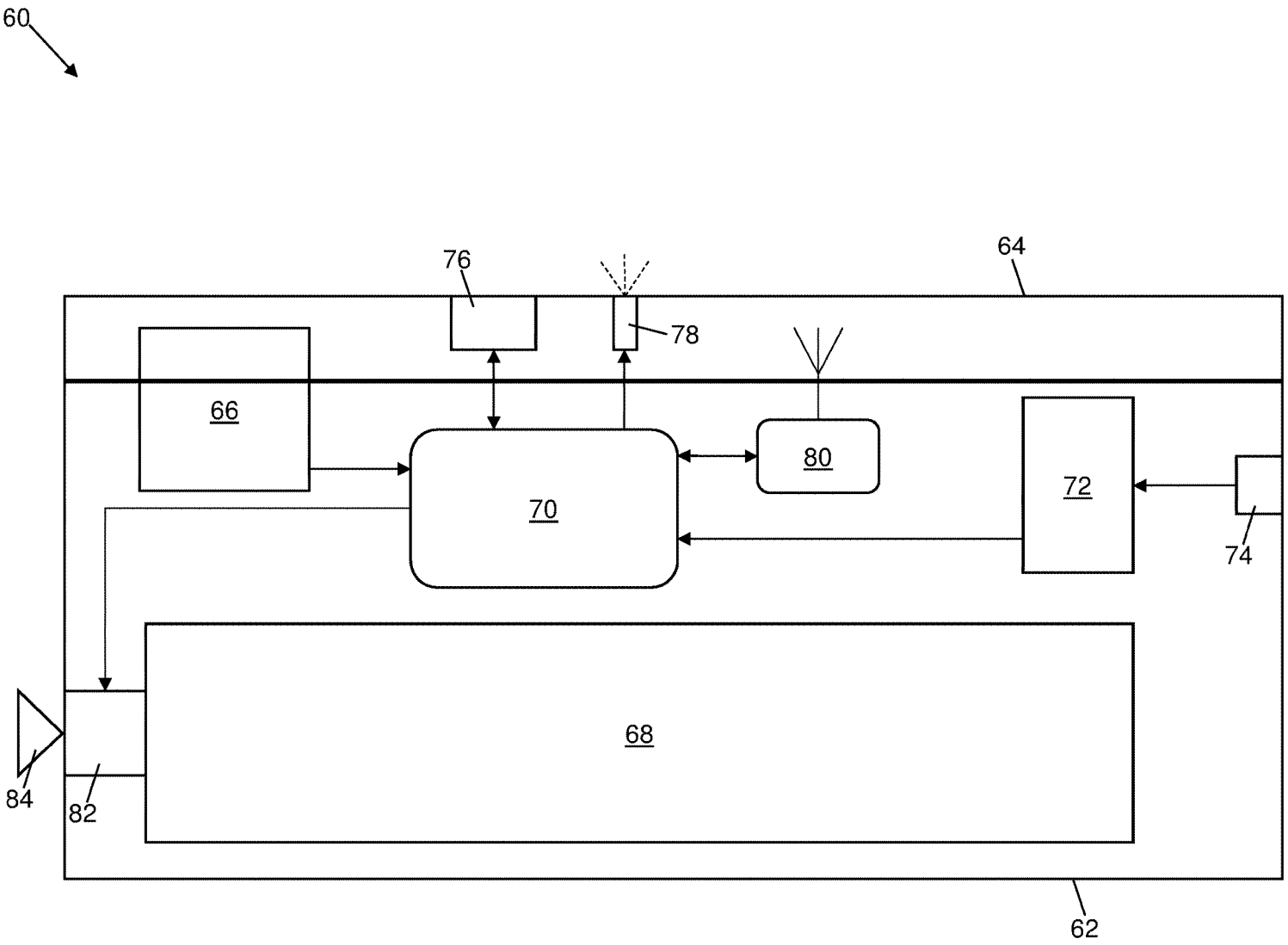
FIG. 3 is a schematic representation of one example of a security device for installation in a machine for dispensing, receiving or recycling cash.

FIG. 3 is a schematic representation of an example of a security device for installation in the ATM 10 or another machine for dispensing, receiving or recycling cash. In this example the security device, shown generally at 60, takes the form of a modified cash cassette, having a base 62 to which a lid 64 is securely attached to prevent access to the interior of the security device 60. Accordingly, the security device 60 in this example is substantially the same shape and size as a standard cash cassette for use in the ATM 10, and has an appearance that is substantially the same as that of a standard cash cassette for use in the ATM 10. Thus, the security device 60 shown in FIG. 3 can be received and accommodated in one of the cash cassette bays 16, 18, 20, 22 of the ATM 10 in place of one of the cash cassettes 24, 26, 28, 30. In the following description it will be assumed that the security device 60 is installed in the lowermost cash cassette bay 22 in place of the cash cassette 30 (as in FIG. 2), but it will be appreciated that the security device 60 could be installed in any one of the cash cassette bays 16, 18, 20, 22 of the ATM 10 in place of any one of the cash cassettes 24, 26, 28, 30.

The primary purpose of the security device 60 illustrated in FIG. 3 is to neutralise attacks on the ATM 10 in which an explosive gas is introduced into the ATM 10 and subsequently ignited to breach the ATM 10 and gain access to the cash cassettes 24, 26, 28, stored in the cash cassette bays 16, 18, 20. To this end, the security device 60 includes a gas sensor 66 and a canister 68 of a compressed neutralising gas, which may be carbon dioxide, an inert gas such as argon, or any other suitable neutralising gas.

The security device 60 is controlled by a controller 70, which is powered by a rechargeable battery 72. A charging port 74 is electrically connected to the battery 72, to permit the battery 72 to be recharged when the security device 60 is not in use, or when the security device 60 is installed in an ATM 10, provided that a suitable power supply is available. Alternatively, the security device 60 may be powered by a power supply unit of the ATM 10 in which it is installed, or by a mains electrical supply, in which case the security device 60 may include one or more power connectors by means of which the security device 60 can be connected to the power supply unit of the ATM 10 or to the mains power supply. Such an arrangement makes it more time consuming to remove the security device 60 from the ATM 10, as the device 60 must be disconnected from the mains power supply, but the device 60 is nevertheless removable, as the device 60 is not permanently received within the ATM 10.

An on/off switch 76 is provided, to permit the security device 60 to be deactivated when not in use. A status indicator 78, which may be, for example, a light emitting diode (LED) or a digital display such as a liquid crystal display (LCD) is provided, and is connected to the controller 70, such that the current status of the security device 60 can be readily ascertained by a user such as a member of staff at a financial institution such as a bank. A wireless communication system 80 is also connected to the controller 70 for bidirectional communication with the controller 70, to allow the controller 70 to report the status of the security device 60 to a remote device such as a module hosted within the ATM 10, and to receive commands and status information from the remote device.

An input of the controller 70 is connected to an output of the gas sensor 66, whilst an output of the controller 70 is connected to an electrically operated control valve 82 which seals an outlet of the canister 68. The electrically operated control valve 82 itself has an outlet 84, which permits the compressed gas contained within the canister 68 to escape into the housing 12 of the ATM 10 when the electrically operated control valve 82 is opened.

The gas sensor 66 is operative to detect one or more explosive gases, or a class of explosive gas, and to output a signal representative of the concentration of the detected gas or gases to the controller 70. The controller 70 compares this signal to a pre-set threshold, and if the detected concentration of gas meets the threshold, outputs a signal to the electrically operated control valve 82 to cause the valve 82 to open, thereby releasing the compressed gas from the canister 68. The compressed gas released in this way neutralises the explosive gas introduced into the ATM 10 by forcing the explosive gas out of the ATM 10, thereby preventing the explosive gas introduced into the ATM 10 from being ignited.

Figure 4:
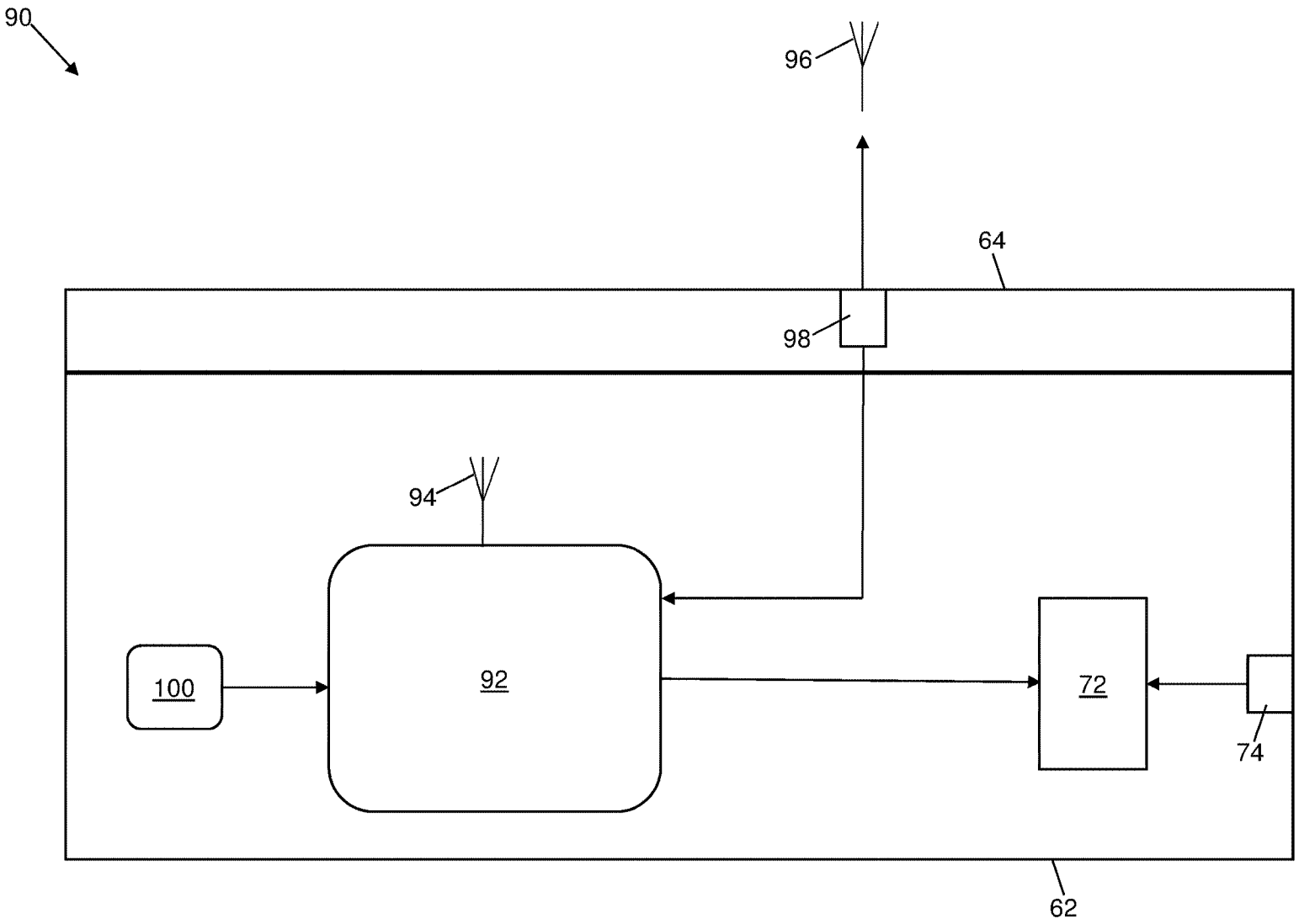
FIG. 4 is a schematic representation of an alternative example of a security device for installation in a machine for dispensing, receiving or recycling cash.

Turning now to FIG. 4, an alternative example of a security device for installation in a machine for dispensing, receiving or recycling cash such as the ATM 10 is shown generally at 90. The security device 90 shares many features with the security device 60 of FIG. 3, and so common features are denoted with common reference numerals in FIGS. 3 and 4. The features of the security device 90 of FIG. 4 may be provided in addition to the gas neutralisation features of the security device 60 of FIG. 3, or instead of those gas neutralisation features.

In an attack on the ATM 10, particularly an attack using explosive gas, it is often the case that the criminals will remove the cash cassettes 24, 26, 28, 30 from the ATM 10 and drive them to a different location as quickly as possible, to reduce the risk of being caught. Also, in attacks in which the entire ATM 10 is removed from its location the cash cassettes 24, 26, 28, 30 remain inside the ATM 10 until it is possible for the criminals to access them.

The security device 90, like the security device 60, takes the form of a modified cash cassette, having a base 62 to which a lid 64 is securely attached to prevent access to the interior of the security device 90. Accordingly, the security device 90 in this example is substantially the same shape and size as a standard cash cassette for use in the ATM 10, and has an appearance that is substantially the same as that of a standard cash cassette for use in the ATM 10. Thus, the security device 90 shown in FIG. 4 can be received and accommodated in one of the cash cassette bays 16, 18, 20, 22 of the ATM 10 in place of one of the cash cassettes 24, 26, 28, 30.

The security device 90 includes a tracker 92 for tracking the location or position of the security device 90. As will be appreciated by those skilled in the relevant art, many different tracking technologies are available. One suitable system for use as the tracker 92 includes a global positioning system (GPS) receiver for calculating the location or position of the security device and a transmitter for transmitting the calculated position or location to a server via a mobile telephony network such as a GSM network. Alternatively or additionally, a device such as a radio beacon could be incorporated into the tracker 92, to permit the security device 90 to be located using a directional antenna. The applicant's international patent application no. WO2011/018652 describes a number of systems that may be incorporated into the tracker 92 to assist in the location of the security device.

The tracker 92 has an antenna or antenna array 94, which is located within the security device 90. The tracker 92 may also be connected to a further antenna or antenna array 96 which is located outside the ATM 10, for example on an external wall of the ATM 10, by means of a connector 98, to which a complementary connector of the ATM 10 may be connected when the security device 90 is installed in one of the cash cassette bays 16, 18, 20, 22 of the ATM 10. The antenna or antenna array 94 permits the tracker 92 to transmit and receive signals, to facilitate calculation of the position or location of the security device 90 and transmission of this data to a server. However, when the security device 90 is installed within the ATM 10, the housing 12 of the ATM 10 will act as a shield for incoming and outgoing signals, greatly attenuating those signals. This attenuation may adversely affect the calculation of the position or location of the security device 90 and the transmission of this data by the tracker 92. However, the connection to the external antenna or antenna array 96 alleviates this problem, as the external antenna or antenna array 96 will be much less affected by the shielding effect of the ATM housing 12.

The security device 90 also includes a motion sensor 100, having an output which is connected to an input of the tracker 92. To conserve power and to prevent significant amounts of data being transmitted by the tracker 92 unnecessarily (thereby potentially giving rise to expensive bills for the user of the security device), the tracker 92 is configured to activate and begin transmitting data only when a movement lasting for a particular duration or in a particular direction is sensed by the motion sensor 100. Thus, the tracker 92 monitors the output of the motion sensor 100, and begins tracking and transmitting data only when the duration for which movement has been detected meets a pre-set threshold, or when an angle indicated by the motion sensor 100 meets a pre-set threshold. The frequency with which the location of the security device 90 is transmitted by the tracker 92 may be pre-set, and may be adjusted by an operator tracking the security device 90, by transmitting a re-configuration message which is received by the tracker 92 via the internal or external antenna or antenna array 94, 96.

The tracker 92 and motion sensor are powered by a rechargeable battery 72, which in turn is connected to a charging port 74 to permit charging of the battery 72 when the security device 90 is not in use.

It will be appreciated that the tracker 92 of the security device 90 illustrated in FIG. 4 permits the location of the security device 90 to be determined and tracked, which can greatly assist in locating the ATM 10, cash cassettes 24, 26, 28, 30 and the responsible individuals in the event of an attack on the ATM 10 in which the ATM 10 or the cash cassettes 24, 26, 28, 30 and security device 90 are quickly moved to a different location.

Figure 5:
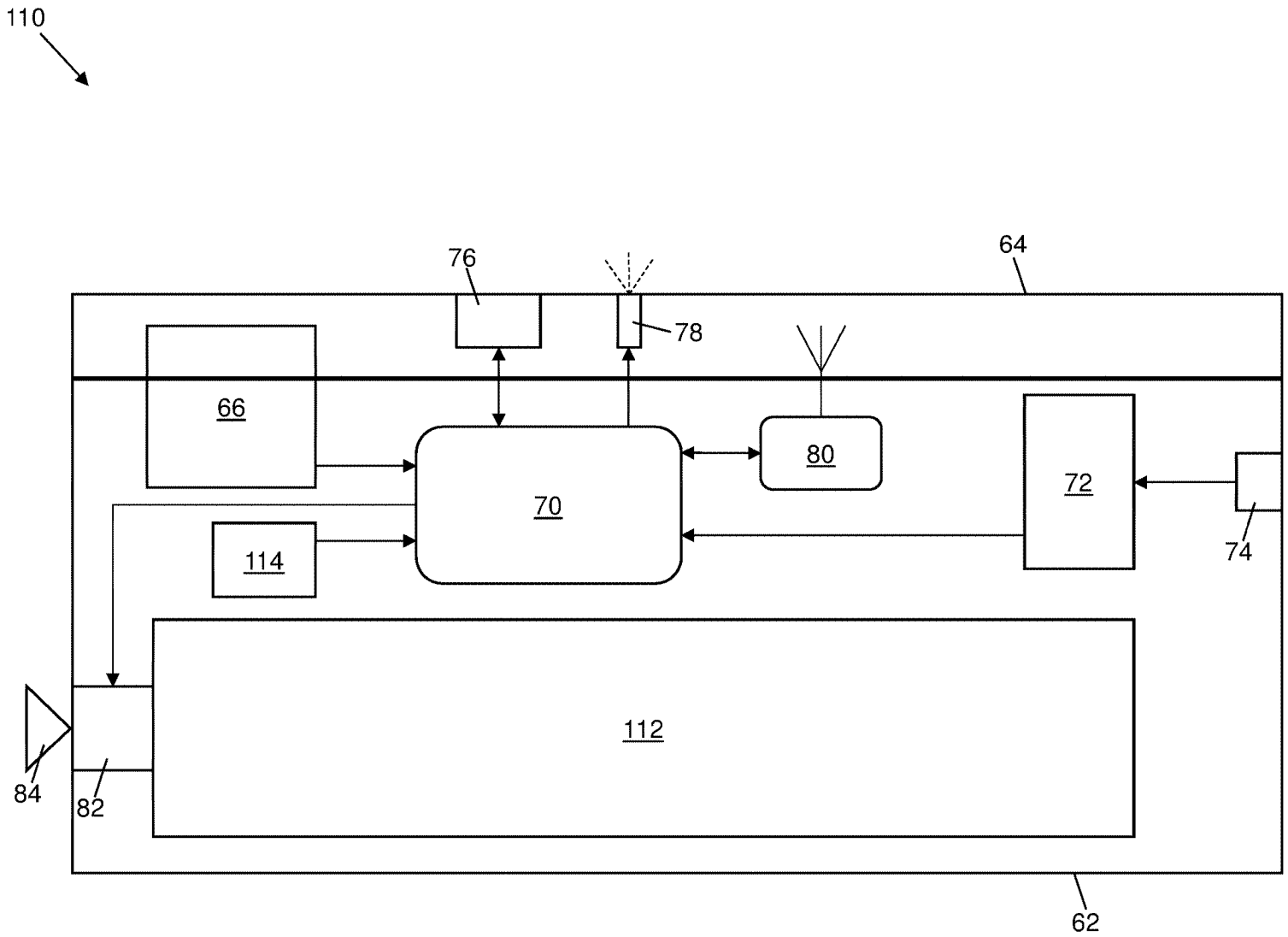
FIG. 5 is a schematic representation of a further alternative example of a security device for installation in a machine for dispensing, receiving or recycling cash.

FIG. 5 is a schematic representation of a further alternative example of a security device. As before, the security device of FIG. 5 (shown generally at 110) shares many features with the security devices 60, 90 of FIGS. 3 and 4, and so common features are denoted with common reference numerals in FIGS. 3, 4 and 5. The features of the security device 110 of FIG. 5 may be provided in addition to the features of the security device 60 of FIG. 3 and those of the security device 90 of FIG. 4, or instead of any or all of the features of the security devices 60, 90.

The security device 110 illustrated in FIG. 5 is similar in structure and operation to the security device 60 illustrated in FIG. 3, and so for the sake of brevity those elements of the security device 110 that are the same as elements described above in relation to the security device 60 will not be described again here.

In place of the canister 68 of compressed neutralising gas used in the security device 60, the security device 110 of FIG. 5 incorporates a canister 112 containing a taggant such as DNA, a rare earth/metal mixture or a UV identifier (i.e. an identifier that is visible under ultraviolet light). The taggant may include any combination of these elements. For example, the taggant may include DNA in combination with a UV identifier, or a rare earth/metal mixture in combination with a UV identifier. Further, additional or alternative taggant elements may be used. Thus, the security device 110 of FIG. 5 is intended to permit identification of individuals involved in an attack on an ATM 10, by "tagging" those individuals with the taggant, thereby providing an evidential link between the individuals responsible for the attack and the ATM 10 attacked.

The security device 110 also includes a motion sensor 114, having an output which is connected to an input of the controller 70. The motion sensor 114 is configured to detect motion of the security device 110, and to output a signal indicative of such motion to the controller 70.

As in the security device 60 illustrated in FIG. 3, the contents of the canister 112 are compressed, such that in the event that the electronic control valve 82 is actuated by an appropriate control signal issued by the processor 70 the taggant contained in the canister 112 is released, via the outlet 84, onto individuals involved in an attack on the ATM 10, and onto the ATM 10 and the security device 110, thereby providing an evidential link between the individuals involved in the attack and the ATM 10 and security device 110. Such a control signal may be issued by the controller 70, for example, on detection by the gas sensor 66 of a concentration of explosive gas that meets a pre-set threshold, or on detection by the motion sensor of movement that meets a pre-set threshold for duration of movement of the security device 110 or angle of inclination of the security device 110.

To increase the likelihood that the individuals responsible for the attack will be "tagged" by the taggant, the controller 70 may delay actuation of the electronic control valve 82 for a predetermined period of time sufficient to ensure that the taggant is released after the housing 12 of the ATM 10 has been breached by the ignition of explosive gas introduced into the housing 12 during the attack, at which time the individuals responsible for the attack are likely to be in close proximity to the security device 110. This predetermined period of time may be in the range of a few seconds to over a minute, for example.

Figure 6:
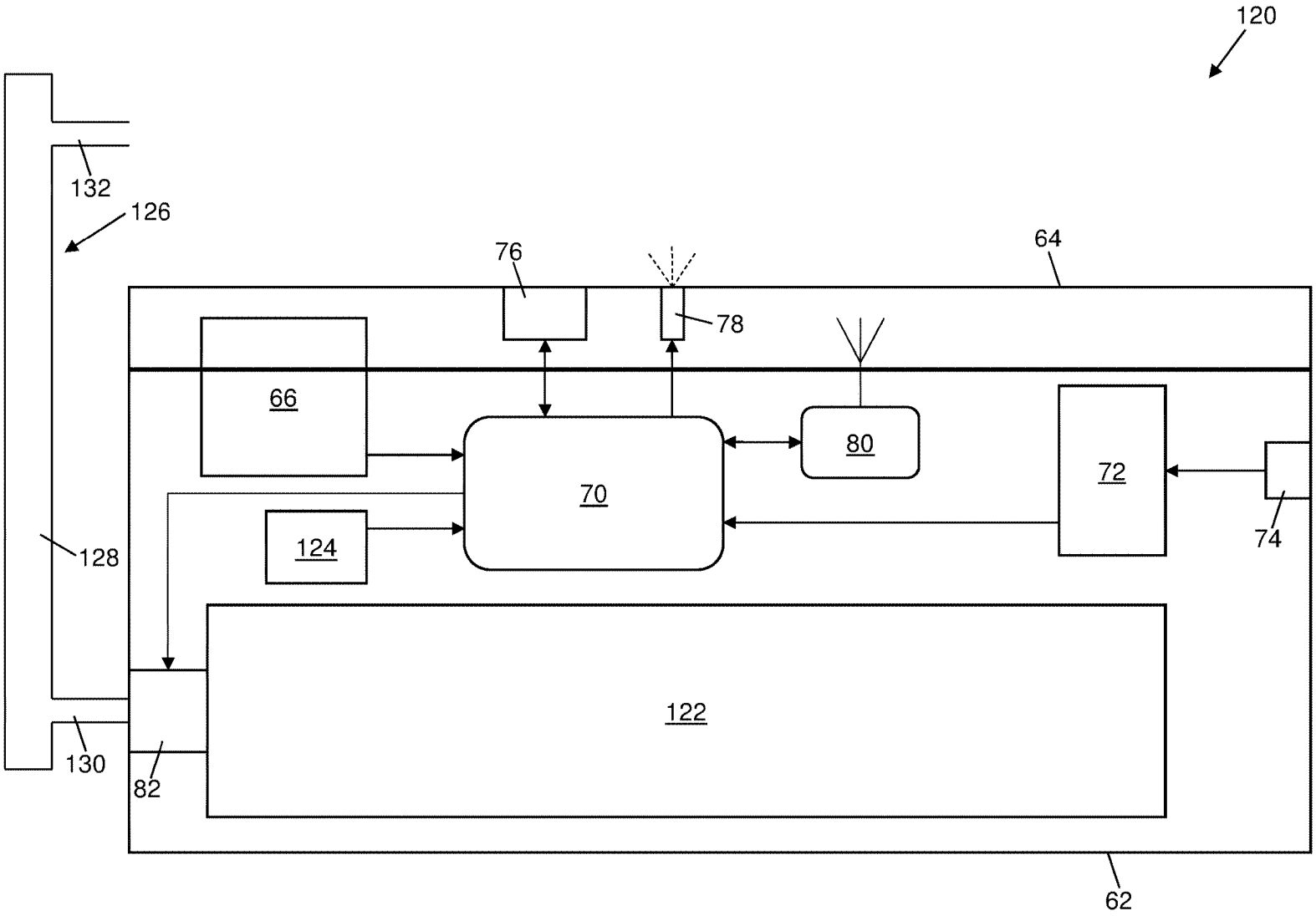
FIG. 6 is a schematic representation of a further alternative example of a security device for installation in a machine for dispensing, receiving or recycling cash.

FIG. 6 is a schematic representation of a further alternative example of a security device. As before, the security device of FIG. 6 (shown generally at 120) shares many features with the security devices 60, 90, 110 of FIGS. 3, 4 and 5, and so common features are denoted with common reference numerals in FIGS. 3-6. The features of the security device 120 of FIG. 6 may be provided in addition to the features of the security devices 60, 90 and 110 of FIGS. 3-5, or instead of any or all of the features of the security devices 60, 90, 110.

The security device 120 illustrated in FIG. 6 is similar in structure and operation to the security device 110 illustrated in FIG. 5, and so for the sake of brevity those elements of the security device 120 that are the same as elements described above in relation to the security device 110 will not be described again here.

In place of the canister 112 of compressed taggant used in the security device 110, the security device 120 of FIG. 6 incorporates a canister 122 containing a spoiling agent such as an ink, dye or adhesive. The spoiling agent may also include one or more taggants, such as DNA, a rare earth/metal mixture or a UV identifier (i.e. an identifier that is visible under ultraviolet light). Thus, the security device 120 of FIG. 6 is intended to spoil or degrade the contents of the ATM 10 in the event that an attack is detected, by dispensing the spoiling agent from the canister 122, thereby rendering any bank notes stored in the ATM 10 unusable and therefore worthless.

The security device 120 also includes a motion sensor 124, having an output which is connected to an input of the controller 70. The motion sensor 124 is configured to detect motion of the security device 120, and to output a signal indicative of such motion to the controller 70.

As in the security device 110 illustrated in FIG. 5, the contents of the canister 122 are compressed, such that in the event that the electronic control valve 82 is actuated by an appropriate control signal issued by the processor 70 the spoiling agent contained in the canister 122 is released. In an alternative arrangement, the spoiling agent may be stored in the canister 122 at atmospheric pressure, and a canister of compressed carbon dioxide or a gas generator could be used to pressurise the canister 122 and force the spoiling agent out of the canister 122 under pressure when an appropriate control signal is issued by the processor 70. Many such systems will be familiar to those skilled in the art, and suitable systems are described in the applicant's UK patent application no. GB2498719 and in the applicant's European patent application no. EP2545536.

Such a control signal may be issued by the controller 70, for example, on detection by the gas sensor 66 of a concentration of explosive gas that meets a pre-set threshold, or on detection by the motion sensor of movement that meets a pre-set threshold for duration of movement of the security device 120 or angle of inclination of the security device 120.

In order to ensure that the spoiling agent contained in the canister 122 reaches the contents of the cash cassettes 24, 26, 28 received in the bays 16, 18, 20 of the ATM 10 (assuming that, as in FIG. 2, the security device 120 is installed in the lowermost bay 22 of the ATM 10), a distribution device 126 is provided to connect the electronic control valve 82 of the security device 120 to the cash cassettes 24, 26, 28, 30 received in the bays 16, 18, 20, 22 of the ATM 10, as will be described below with reference to FIG. 6 and FIG. 7, which is a schematic representation showing an ATM in which the security device 120 of FIG. 6 has been installed.

The distribution device 126 takes the form of an elongate generally hollow feed pipe 128, having a plurality of open-ended hollow branches 130, 132, 134, 136 in fluid communication with the elongate hollow feed pipe 128. The feed pipe 128 and branches 130, 132, 134, 136 may be rigid, or may alternatively be flexible.

Figure 7:
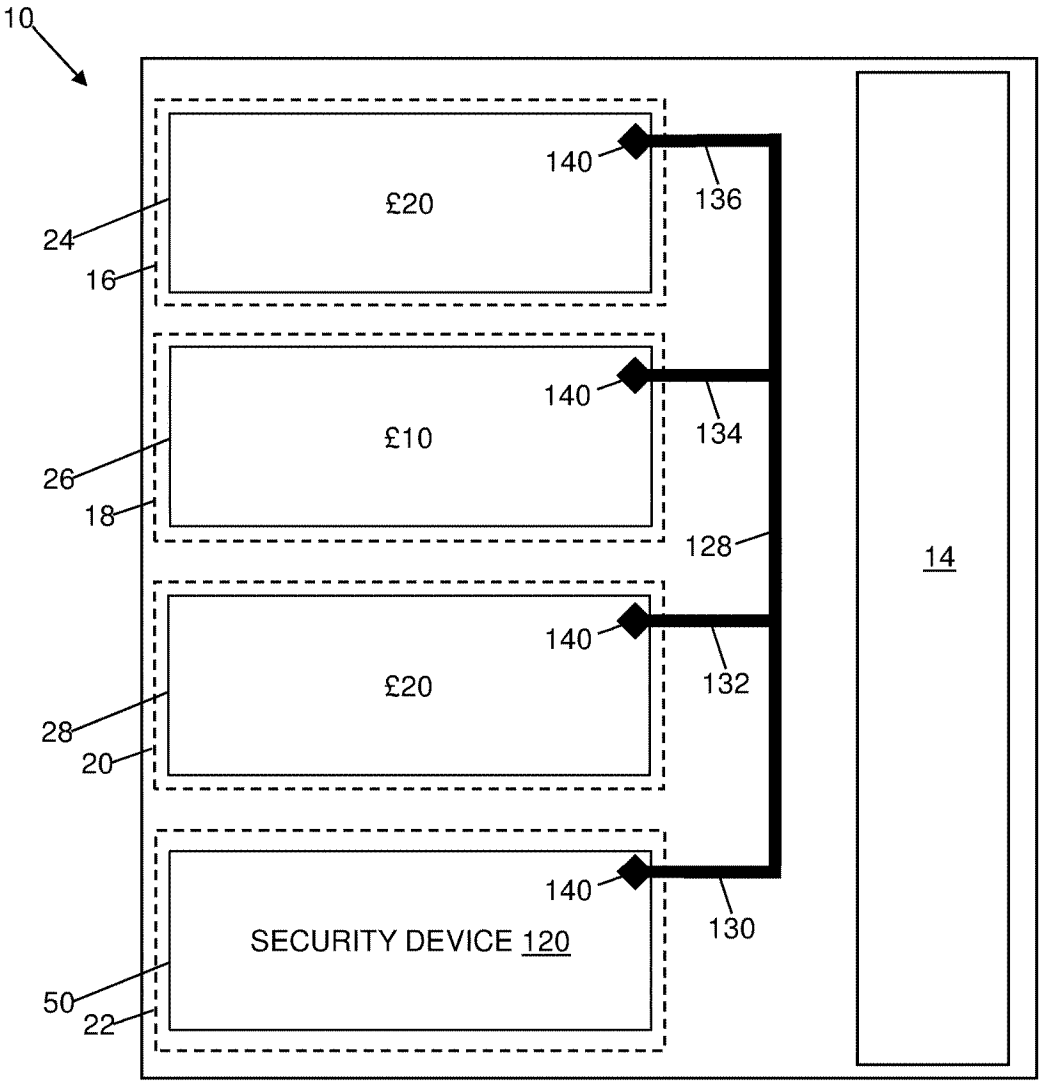
FIG. 7 is a schematic representation of an ATM equipped with the security device of FIG. 6.

As can be seen in FIG. 6, one of the plurality of branches 130 can be connected to the electronic control valve 82 of the security device 120, whilst each of the other branches 132, 134, 136 can engage with the cash cassettes 24, 26, 28 by being connected to a coupling 140 of one the cash cassettes 24, 26, 28, as shown in FIG. 7, which is in turn connected to and in fluid communication with a dispensing system such as a spray head or a spray bar within the cash cassette, such that on release of the spoiling agent contained in the canister 122 the spoiling agent will be dispensed over the contents of the cash cassettes 24, 26, 28. Alternatively, where the coupling 140 and dispensing system is not provided in a cash cassette, the branches 132, 134, 136 may engage with the cash cassettes 24, 26, 28 simply by entering the cash cassette though a hole or opening, such that on release of the spoiling agent contained in the canister 122 the spoiling agent will be dispensed over the contents of the cash cassette.

Where the feed pipe 128 and branches 130, 132, 134, 136 are flexible, the branches 130, 132, 134, 136 must be physically connected to or engaged with the electronic control valve 82 of the security device 120 and to the relevant couplings 140 or holes of the cash cassettes 24, 26, 28 when the security device 120 and cash cassettes 24, 26, 28 are installed in the ATM 10. On the other hand, if the feed pipe 128 and branches 130, 132, 134, 136 are rigid, the branches 130, 132, 134, 136 may automatically engage with the couplings 140 or holes when the cash cassettes 24, 26, 28, 30 are installed in a cash cassette bay 16, 18, 20, 24 of the ATM 10, if the security device 120 and distribution device 126 have already been installed in a cash cassette bay 16, 18, 20, 24 of the ATM 10.

Figure 8:
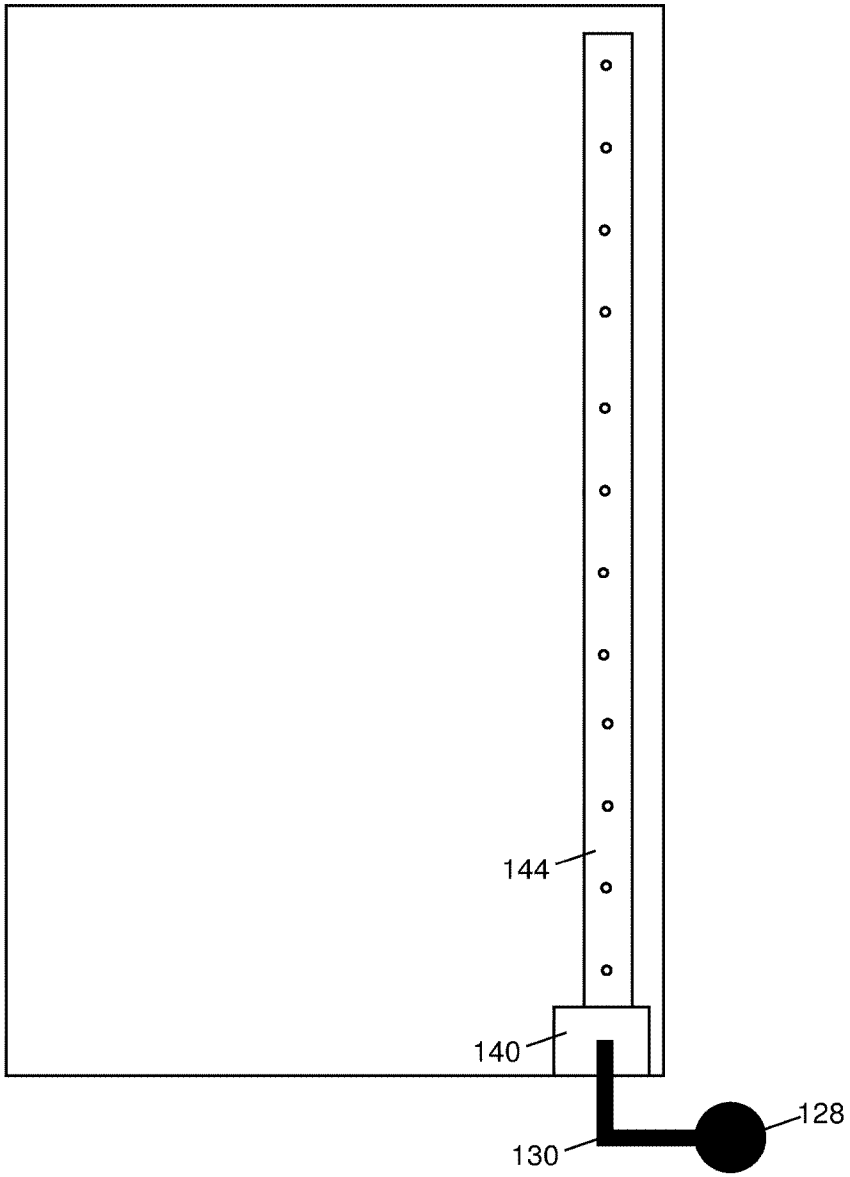
FIG. 8 is a schematic cross-sectional view from above, showing a cash cassette suitable for installation in the ATM illustrated in FIG. 7.

FIG. 8 is a schematic cross-sectional view from above, showing a cash cassette (e.g. cash cassette 24, 26, 28, 30) suitable for installation in the ATM 10. As can be seen from the Figure, the cash cassette in this example includes a coupling 140 which is connected to and in fluid communication with a spray bar 144, to permit a spoiling agent released from the canister 122 of the security device 120 to be dispensed widely within the cash cassette. Also shown in FIG. 8 is the feed pipe 128 of the distribution device 126, with a branch 130 physically connected to and in fluid communication with the coupling 140, such that fluid passing through the feed pipe 128 can pass through the coupling 140 to the spray bar 144.

Figure 9:
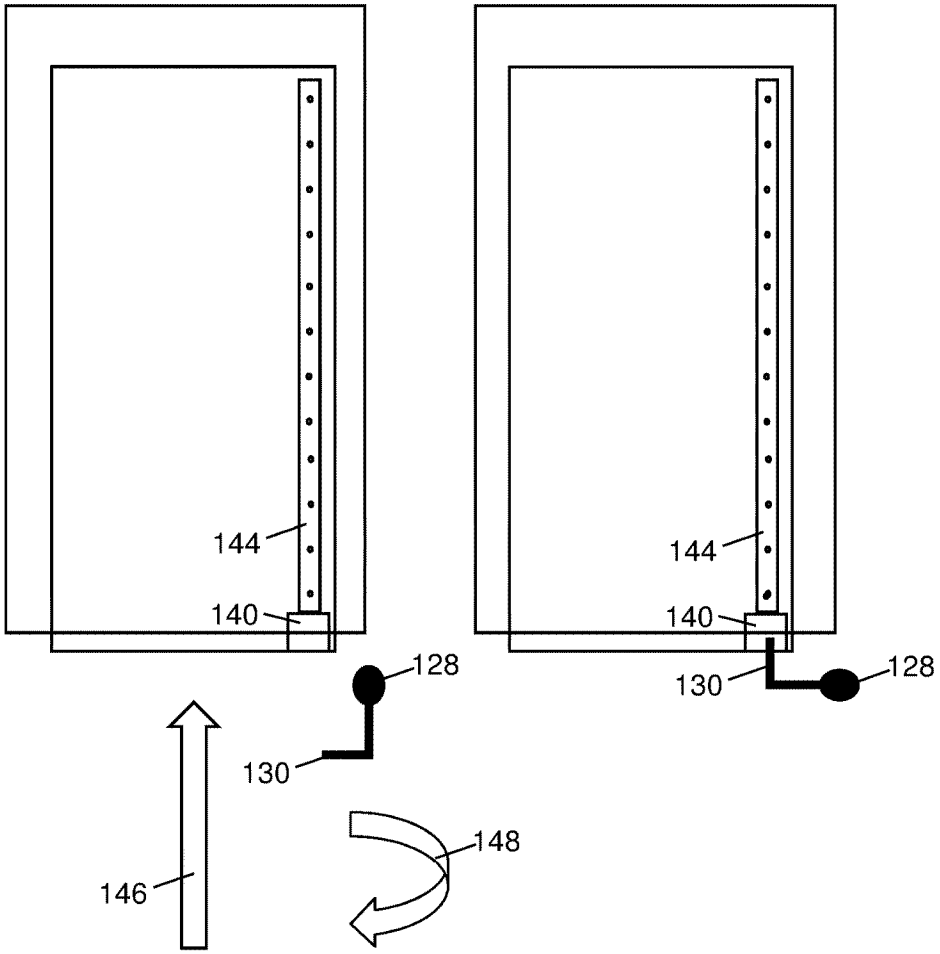
FIG. 9 is a schematic cross-sectional view from above, showing the cash cassette of FIG. 8 installed in an ATM.

FIG. 9 is a schematic cross-sectional view from above, showing a cash cassette (e.g. cash cassette 24, 26, 28, 30 installed in the ATM 10, with the distribution device 126 shown in a first position in the image on the left-hand side of the Figure and the distribution device 126 shown in a second position in the image on the right-hand side of the Figure, to illustrate how the distribution device 126 may be used to impede removal of the cash cassette from the ATM 10, as will now be described.

If the feed pipe 128 of the distribution device 128 is rigid, it can be rotatable and lockable. Thus, the feed pipe 128 may be rotatably installed within the ATM 10, for rotation between a first position, as shown in the left-hand side of FIG. 9, in which the branches 130, 132, 134, 136 do not engage with the couplings 140 or holes of any cash cassettes installed within the ATM 10, and a second position, as shown in the right-hand side of FIG. 9, in which the branches 130, 132, 134, 136 engage with the couplings 140 or holes of the cash cassettes installed within the ATM 10. The feed pipe 128 may be lockable in the second position or in both the first position and the second position by means of a mortice lock or other locking mechanism.

In order to install a cash cassette 24, 26, 28, 30 or a security device 120 in a cash cassette bay 26, 18, 20, 22 of the ATM 10, the feed pipe 128 is moved to the first position, as shown in the image on the left-hand side of FIG. 9. The cash cassette is installed in the bay, by moving it in the direction shown by the arrow 146 of FIG. 9. The feed pipe 128 is then rotated in a clockwise direction, as indicated by the arrow 148 of FIG. 9, such that appropriate ones of the branches 130, 132, 134, 136 engage with the couplings 140 or holes of the cash cassettes 24, 26, 28 installed within the ATM 10, and with the electrically operated control valve 82 of a security device 120 installed in the ATM 10, to provide a fluid flow path between the canister 122 of spoiling agent and the interior of each of the installed cash cassettes 24, 26, 28, 30. The feed pipe 128 is then locked in this position, thereby presenting a physical obstacle which impedes removal of the cash cassettes 24, 26, 28 and security device 120 from the ATM 10. In order to remove a cash cassette 24, 26, 28 from the ATM 10, the feed pipe 128 must be unlocked and rotated in an anti-clockwise direction back to the position shown in the left-hand image of FIG. 9.

In FIGS. 7-9, the distribution device 126 including feed pipe 128 and branches 130, 132, 134, 136 are shown as being located towards the front of the ATM 10. Similarly, the couplings 140 or holes of the cash cassettes are shown as being located towards the front of the cash cassettes. However, it will be appreciated that it may be necessary, due to the mechanics of the ATM 10, the layout of the cash cassettes or other factors for the distribution device 126 to be located elsewhere within the ATM 10, and for the couplings 140 or holes to be located elsewhere in the cash cassettes.

In the exemplary security devices described above, gas sensors and motion sensors are used to detect attacks on the ATM 10. As is well known in the art, additional or alternative sensors could be used to detect attacks on the ATM 10 or on the cash cassette itself. For example, the ATM and/or security device could include one or more penetration sensors, liquid sensors, temperature sensors, impact sensors or any other type of sensor to detect attacks, and the security device could include a sensor for detecting opening or removal of the lid 64.

Further, although a number of cash protection and neutralisation systems have been described above as forming part of the security devices, it will be appreciated that additional or alternative systems and modules could also be included in the security devices. For example, still and moving image recording modules (e.g. digital cameras) and/or sound recording modules (e.g. microphones) might also be included in the security devices, such that on detection by the sensing components of the security devices of an attack, video and/or audio recording is commenced, with image and/or sound data being periodically transmitted to a server by means of a communications module within the security device, to permit useful image and/or sound evidence to be gathered, to facilitate tracking, capture and prosecution of the individuals responsible for the attack.

The exemplary security devices 60, 90, 110, 120 described above and illustrated in FIGS. 3-6 are described as being modified cash cassettes. This is advantageous for at least the following reasons. First, modifying a standard cash cassette that is suitable for installation in the ATM 10 to manufacture a security device ensures that the security device will be correctly received in the cash cassette bays 16, 18, 20, 22 of the ATM 10 (provided of course that the general shape and dimensions of the cash cassette have not been modified). Secondly, the use of a modified cash cassette helps to disguise the purpose of the security device, making it more difficult for a criminal involved in an attack on an ATM or other cash dispensing, receiving or recycling machine to identify the security device and attempt to disable it.

As will be readily appreciated from the foregoing description, the removable security devices described herein provide an efficient and cost effective solution to the problem of protecting ATMs and other cash dispensing, receiving or recycling machines in the face of a continually moving threat. Instead of incurring the cost and time penalties of installing permanent security systems in their machines, financial institutions and other operators of such machines can purchase a limited number of security devices of the kind described herein, and install them in their machines in response to specific threats. This approach has the additional benefit of not permanently reducing the cash storage capacity of the affected machines, as some permanent security installations do. Whilst the cash storage capacity will be temporarily reduced with the security device is installed in an ATM or other machine (as the security device takes the place of one cash cassette and does not itself hold or store any cash), once the threat has receded, the security device can quickly be removed, to be replaced by a cash cassette, thereby restoring the machine to its normal cash storage capacity.

Figure 10:
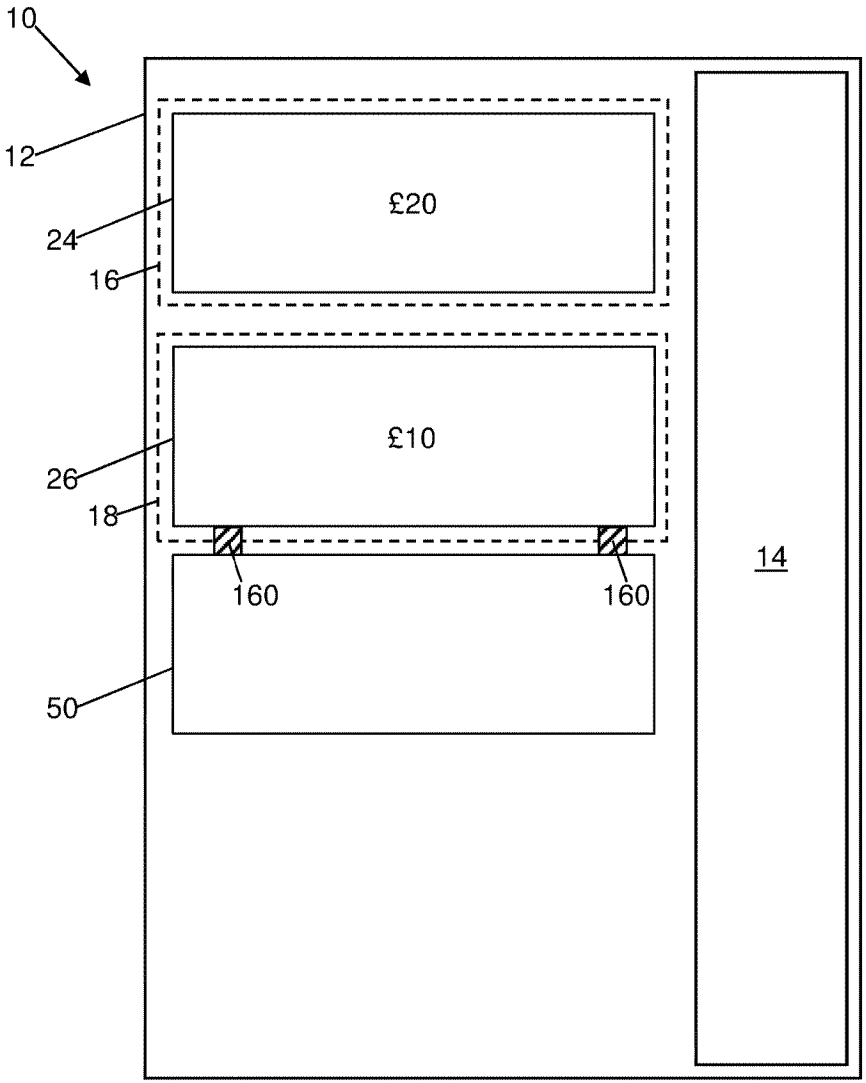
FIG. 10 is a schematic representation of an ATM in which a security device has been installed so as to occupy part of a cash space of the ATM

FIG. 10 is a schematic representation of the ATM 10 of FIG. 1, in which a removable portable security device, shown at 50, has been installed so as to occupy part of a cash space of the ATM 10.

In the examples described above, the ATM 10 is provided with four cash cassette bays 16, 18, 20, 22, which are located within a cash space (i.e. a space intended for storage of cash) of the ATM 10. The removable portable security device 50 in the examples described above is received in one of the bays, and therefore takes the place of one of the ATM cassettes. In an alternative implementation, the removable portable security device 50 may not occupy an ATM cassette bay of the ATM (or other cash handling machine), but may instead be configured to occupy part of the cash space of the machine.

For example, in the ATM 10 of FIG. 10, only two ATM cassette bays 16, 18 are provided. Part of the remainder of the cash space is occupied by a removable portable security device 50 of the kind described above which, in the example illustrated in FIG. 10, is provided with one or more attachment devices 160, such as clips, magnets or any other suitable attachment device, by means of which the security device 50 can be removably attached to the underside of a bay 18 of the ATM 10. Alternatively, the security device may removably be attached to the floor or a wall of the cash space of the ATM 10, again by one or more attachment devices such as clips, magnets or any other suitable attachment device, to permit the security device 50 to be removably installed in the ATM 10 so as to occupy part of the cash space of the ATM 10.

As described above, the removable security devices can be installed in and removed from a cash processing machine such as an ATM 10 in response to a moving threat of theft or attack. However, the removable security device may also be installed in a cash processing machine such as ATM 10 during initial manufacture of the machine, so as to provide a cost-effective permanent or semi-permanent security solution. Thus, during manufacture of an ATM 10 or other cash processing machine a removable security device of the kind described above may be installed in one of the bays 16, 18, 20, 22 intended for receiving cash cassettes, such that on dispatch of the machine to the customer one of the bays that would otherwise be available to receive a cash cassette is occupied by the removable security device.

This arrangement provides a cost effective way of protecting the cash processing machine, since instead of purchasing a machine with an integral cash protection system, a customer can purchase a less costly machine, without any integral cash protection system, and a removable security device of the kind described above. This option is likely to be particularly attractive to smaller scale users such as independent retailers, where demand for cash is less than, for example, high-street banks and so cash storage capacity is of lesser importance.

As well as the potential for reduced initial purchase cost, this solution offers additional benefits in terms of servicing and maintenance of the machine and the security device. As will be appreciated, in order to service the removable security device, the device can be removed from the machine and either replaced with a replacement removable security device or else serviced and replaced. In either event, the servicing operation will be less time consuming than servicing a cash protection system that is integral to a cash processing machine. Moreover, as the removable security device can be removed for the servicing operation, the cash processing machine can remain in operation during the servicing operation. In contrast, where the cash protection system is integral to the cash processing machine, the entire machine must be deactivated in order to service the machine.

Additionally, the use of a removable security device of the kind described above as a permanent or semi-permanent protection mechanism for a cash processing machine facilitates rapid upgrading of the machine's protection in response to new threats. As criminals develop new methods of attacking cash processing machines such as ATMs, new features may be developed for the removable security device to combat such new methods. Upgrading a machine's protection to combat such new methods is then a simple case of replacing the existing removable security device with an upgraded version, rather than having to replace or upgrade an integral protection system.

The invention claimed is:

1. A cash processing machine for dispensing, receiving or recycling cash, the machine comprising a machine housing, the machine housing containing:

a cash space for storing cash, the cash space comprising a bay for receiving and mounting a cash cassette in a position that enables the cash cassette to dispense cash from the cash processing machine;

at least one cash cassette arranged to store and to dispense cash; and a removable portable security device comprising a housing containing:

a detection system for detecting unauthorized interference with the machine; and a cash protection system configured to activate on detection by the detection system of unauthorized interference with the machine, the housing being sized to occupy the bay such that the bay cannot receive a cash cassette, and wherein the cash protection system is configured to dispense a material from the removable portable security device into the machine housing and/or into the at least one cash cassette.

2. A removable portable security device for installation in a machine for dispensing, receiving or recycling cash, the machine including a bay configured to receive a cash cassette, the security device comprising a housing containing:

a detection system for detecting unauthorized interference with the machine; and a cash protection system configured to activate on detection by the detection system of unauthorized interference with the machine, the housing being sized to be mounted in the bay such that the bay cannot receive the cash cassette, and the detection system comprising a gas sensor and the cash protection system comprising a gas neutralization system;

wherein the gas neutralization system includes a control valve to permit neutralization gas to be dispensed to the exterior of the housing and a gas canister occupying a majority of the volume in the housing.

* * * * *